US006227199B1

(12) United States Patent
Garofalo

(10) Patent No.: US 6,227,199 B1
(45) Date of Patent: May 8, 2001

(54) MULTIPLE DISTRIBUTOR FOR LOW-PRESSURE USES

(75) Inventor: Giovanni Garofalo, Rapallo (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/188,227

(22) Filed: Nov. 9, 1998

(30) Foreign Application Priority Data

Dec. 3, 1997 (IT) ..... GE970042 U

(51) Int. Cl.[7] ..... A61M 16/00

(52) U.S. Cl. ..... 128/204.26; 128/205.24; 128/205.22

(58) Field of Search ..... 128/204.18, 204.26, 128/204.27, 204.28, 205.22, 200.24, 201.11, 201.27, 205.24

(56) References Cited

U.S. PATENT DOCUMENTS 3,147,499 * 9/1964 Nelson et al. ..... 128/204.26
4,137,585 2/1979 Wright, III .
4,176,418 * 12/1979 Scott ..... 128/204.26
4,498,471 * 2/1985 Kranz et al. ..... 128/204.26
5,247,926 * 9/1993 Harral ..... 128/204.26
5,293,864 3/1994 McFadden .

OTHER PUBLICATIONS

"Scuba Life Jacket Safeguards . . .", Machine Desgn., vol. 37, No. 26, Aug. 19, 1965, p. 26.

* cited by examiner

*Primary Examiner*—Glenn K. Dawson
(74) *Attorney, Agent, or Firm*—Larson & Taylor, PLC

(57) ABSTRACT

Multiple distributor for low-pressure uses forming part of the equipment of a scuba diver equipped with a self-contained breathing apparatus. A distributor body is connected by a single pipe to the first-stage pressure reducer of one or more cylinders. The body is connected via connectors for with the following: a second-stage pressure reduce for an emergency mouthpiece, a second-stage pressure reducer connected to the diver's mouthpiece, and the inflation connection of a balancing jacket, the air inlet to the latter connection being controlled via an appropriate cut off valve operated by a push-button mounted on the distributor body.

8 Claims, 1 Drawing Sheet

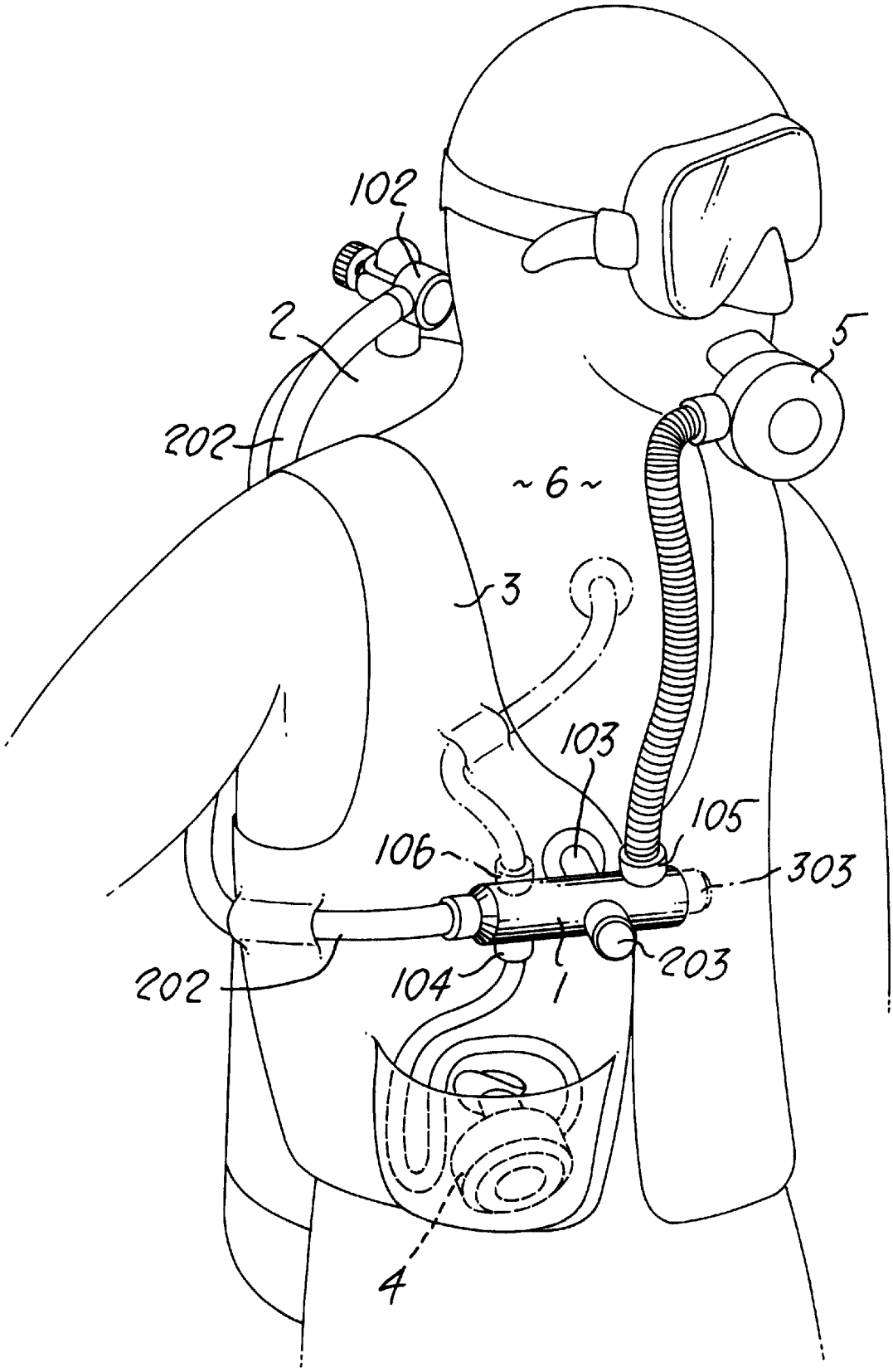
102
2
202
~6~
5
3
103
105
106
303
202
104
1
203
4

MULTIPLE DISTRIBUTOR FOR LOW-PRESSURE USES

BACKGROUND AND SUMMARY OF THE INVENTION

The present invention refers to a multiple distributor for low-pressure uses, forming part of the equipment of a scuba diver equipped with a self-contained breathing apparatus.

The equipment of a scuba diver equipped with self-contained breathing apparatus normally consists, among other things, of a diving suit, a balancing jacket, and a single or double cylinder set, as a source of breathable air.

In turn, this air source comprises a first-stage pressure reducer of the cylinder, from which there proceed a whole series of pipes which are connected to the balancing jacket, for their inflation, to the second-stage pressure regulator, and to a second-stage emergency pressure regulator, and in the case of a water-tight diving suit, also to the air space in the suit itself. Besides being a hindrance to freedom of movement of the diver, all these pipes also constitute a danger, in that they may easily get entangled in various obstacles. In addition, the various controls for inflating and deflating the different elements served by the pipes are not always easy and convenient to reach.

The aim of the invention is to simplify the existing structures, by centralizing all the controls in a position very easy to reach, thus eliminating most of the pipes that branch off from the first stage.

According to the invention, this aim is achieved by getting just one pipe to branch off from the first stage; this pipe conveys the air to a central distributor located on the chest of the scuba diver. From the distributor, there proceed all the connections for the various uses, and here are located all the controls, in a position that is easy to control using just one hand, and in a position that is easy to control in order to avoid entanglement in obstacles.

BRIEF DESCRIPTION OF THE DRAWING

The invention will now be described in greater detail with reference to the single attached drawing, which illustrates a preferred embodiment of the device according to the invention.

DESCRIPTION OF THE PREFERRED EMBODIMENT OF THE INVENTION

As illustrated in the drawing, the distributor comprises one body 1 connected to the first-stage pressure reducer 102 of the cylinder 2 by means of the single pipe 202, which may be either fastened to or incorporated in the balancing jacket. This body 1, which in the case illustrated is a cylindrical body, presents a series of connections, which in the example shown are:

one connection 103 to the balancing jacket 3 which is controlled by a valve that can be operated by means of a push-button 203 set on the distributor itself:

one connection 104 for the pipe that takes to the second-stage emergency regulator 4;

one connection 105 for the pipe that takes to the second-stage regulator 5, i.e., the regulator connected to the diver's mouthpiece.

Eventually, in the case of water-tight suits, this body 1 may also be provided with a connection 106 for a pipe that takes directly to the suit 6.

In addition, the body 1 may also be provided with a push-button 303 for controlling a valve for deflating the balancing jacket.

Obviously, the number of connections that start from the distributor 1, as well as the number of control push-buttons installed on the distributor, may vary according to the needs.

What is claimed is:

1. A multiple distributor for low-pressure uses a scuba diving equipment which includes a self-contained breathing apparatus, in combination with comprising:

a distributor body;

a pipe which connects said distributor body to a first-stage pressure reducer of at least one gas cylinder of the scuba diving equipment;

a first connection by which said distributor body is connectable with a second-stage pressure reducer of an emergency mouthpiece of the scuba diving equipment;

a second connection by which said distributor body is connectable with a second-stage pressure reducer connected to a diver mouthpiece of the scuba diving equipment;

a third connection by which said distributor body is connectable with an inflation connection of a balancing jacket of the scuba diving equipment; and a push-button mounted on said distributor body which is part of a cut off valve in said distributor body which cuts off a flow of gas to said third connection of said distributor body and hence to the inflation connection of the balancing jacket.

2. The combination of claim 1, and further including a fourth connection by which said distributor body is connectable with a pipe directly connected to a water-tight diving suit of the scuba diving equipment.

3. The combination of claim 2, and further including a second push-button mounted on said distributor body which is actuated to deflate the balancing jacket of the scuba diving equipment.

4. The combination of claim 3, and further including a fastener which fastens said pipe to the balancing jacket of the scuba diving equipment.

5. The combination of claim 4, wherein said third connection is configured to locate said distributor adjacent a chest portion of the balancing jacket on which the inflation connection is located.

6. The combination of claim 1, and further including a second push-button mounted on said distributor body which is actuated to deflate the balancing jacket of the scuba diving equipment.

7. The combination of claim 1, and further including a fastener which fastens said pipe to the balancing jacket of the scuba diving equipment.

8. The combination of claim 1, wherein said third connection is configured to locate said distributor adjacent a chest portion of the balancing jacket on which the inflation connection is located.

* * * * *